US010251454B2

(12) United States Patent
Kojima et al.

(10) Patent No.: US 10,251,454 B2
(45) Date of Patent: Apr. 9, 2019

(54) SLIDER COVER OF SLIDE FASTENER AND SLIDER SET

(71) Applicant: YKK Corporation, Tokyo (JP)

(72) Inventors: Masayoshi Kojima, Toyama (JP); Takayuki Inukai, Toyama (JP)

(73) Assignee: YKK Corporation (JP)

( * ) Notice: Subject to any disclaimer, the term of this patent is extended or adjusted under 35 U.S.C. 154(b) by 0 days.

(21) Appl. No.: 15/615,880

(22) Filed: Jun. 7, 2017

(65) Prior Publication Data

US 2017/0360160 A1 Dec. 21, 2017

(30) Foreign Application Priority Data

Jun. 17, 2016 (JP) ..... 2016-002843 U

(51) Int. Cl.
*A44B 19/26* (2006.01)
*B65D 33/25* (2006.01)

(52) U.S. Cl.
CPC ..... *A44B 19/262* (2013.01); *A44B 19/26* (2013.01); *B65D 33/2591* (2013.01)

(58) Field of Classification Search
CPC ..... A44B 19/262
See application file for complete search history.

(56) References Cited

U.S. PATENT DOCUMENTS 2,933,792 A 4/1960 Malmborg
5,007,144 A * 4/1991 Terada ..... A44B 19/26 24/415
9,226,550 B1 * 1/2016 Lin ..... A44B 19/262
9,370,225 B1 * 6/2016 Lin ..... A44B 19/262
9,763,498 B2 * 9/2017 Kojima ..... A44B 19/26
9,968,166 B2 * 5/2018 Inukai ..... A44B 19/265
2007/0163092 A1 * 7/2007 Lin ..... A44B 19/262 24/415
2010/0186200 A1 * 7/2010 Chan ..... A44B 19/262 24/429

(Continued)

FOREIGN PATENT DOCUMENTS

CN 105266285 A 1/2016
JP 3193160 U 8/2017

OTHER PUBLICATIONS

Office Action, Taiwanese Patent Application No. 106119597, dated Sep. 30, 2017.

*Primary Examiner* — Jason W San
(74) *Attorney, Agent, or Firm* — Kilpatrick Townsend & Stockton LLP

(57) ABSTRACT

There is provided a slider cover of a slide fastener. An upper mounting plate includes: an upper plate to be arranged above an upper blade of a slider and formed with a through-hole penetrating therethrough; and an upper wall protruding downward from the upper plate. A lower mounting plate includes: a lower plate to be arranged below a lower blade of the slider; and a lower wall for surrounding front, right and left sides of an outer periphery of the lower blade and protruding upward from the lower plate. At least one of the upper and lower mounting plates includes a protrusion protruding from an inner peripheral surface of at least corresponding one of the upper and lower walls and configured to come in close contact with a part of an outer peripheral surface of at least corresponding one of the upper and lower blades.

14 Claims, 11 Drawing Sheets

(56) References Cited

U.S. PATENT DOCUMENTS

| | | | | |
|---|---|---|---|---|
| 2013/0174387 | A1* | 7/2013 | Hamada | A44B 19/306<br>24/418 |
| 2013/0318751 | A1* | 12/2013 | Lin | A44B 19/42<br>24/429 |
| 2015/0237973 | A1* | 8/2015 | Kojima | A44B 19/262<br>24/429 |
| 2015/0313321 | A1* | 11/2015 | Miyazaki | A44B 19/308<br>24/429 |
| 2015/0335107 | A1* | 11/2015 | Hamada | A44B 19/26<br>24/429 |
| 2015/0351501 | A1* | 12/2015 | Zana | A44B 19/26<br>24/429 |
| 2016/0007694 | A1* | 1/2016 | Smith | A44B 19/26<br>24/418 |
| 2016/0135552 | A1* | 5/2016 | Li | A44B 19/308<br>24/424 |
| 2016/0143401 | A1* | 5/2016 | Miyazaki | A44B 19/308<br>24/420 |

* cited by examiner

SLIDER COVER OF SLIDE FASTENER AND SLIDER SET

CROSS-REFERENCE TO RELATED APPLICATIONS

The disclosure of Japanese Utility Model Application No. 2016-002843 filed on Jun. 17, 2016, including specification, drawings and claims is incorporated herein by reference in its entirety.

TECHNICAL FIELD

The present invention relates to a slider cover to be mounted on a slider of a slide fastener, and to a slider set having a slider cover and a slider.

BACKGROUND

As one example of conventional slider covers, there is a slider cover for receiving a slider therein, which has upper and lower structures configured to be mounted on upper and lower sides of the slider, respectively, and a front coupling portion connecting front portions of the upper and lower structures at the front side of the slider (see Patent Document 1). The upper structure has an annular portion configured to be arranged above an upper blade of the slider and a pair of wall portions protruding downward from the right and left sides of the annular portion. Also, the pair of wall portions is configured to receive the upper blade in a space therebetween in a right and left direction, thereby restricting the upper blade from being displaced in the right and left direction.

The lower structure has a plate-shaped lower main portion configured to be arranged below a lower blade of the slider, a lower sub-portion protruding forward from the lower main portion and then protruding upward in a stepped shape. A rear surface of the lower sub-portion is configured as a recess portion recessed forward to correspond to a shape of the lower blade.

Although not described in Patent Document 1, when designing a slider cover, it is a technical common sense that the pair of wall portions and the recess are formed to be slightly larger than outer peripheral shapes of the upper blade and the lower blade. In other word, it is a technical common sense that a gap is formed between an inner peripheral surface of the slider cover and an outer peripheral surface of the slider.

Patent Document 1: Japanese Utility Model Registration No. 3193160U

Since a gap exists between the inner peripheral surface of the slider cover and the outer peripheral surface of the slider, when the slider is operated to open or close a slide fastener, the slider cover mounted outside of the slider is rattled and thus a noise is generated.

Even so, it is difficult in terms of manufacturing technology to perfectly conform a shape of the inner peripheral surface of the slider cover to a shape of the outer peripheral surface of the slider in order not to generate a noise.

SUMMARY

It is therefore an object of the present invention to provide a slider cover in which rattling of the slider cover when a slider is operated is prevented as much as possible.

According to an aspect of the embodiments of the present invention, there is provided a slider cover of a slide fastener, comprising: an upper mounting plate configured to be mounted on an upper side of a slider; a lower mounting plate configured to be mounted on a lower side of the slider; and a column-shaped connecting post connecting a front portion of the upper mounting plate and a front portion of the lower mounting plate at a front side of the slider, wherein the upper mounting plate comprises: an upper plate configured to be arranged above an upper blade of the slider and formed with a through-hole penetrating through the upper mounting plate in an upward and downward direction in order to allow a pull tab of the slider to pass through the through-hole; and an upper wall protruding downward from the upper plate, wherein the lower mounting plate comprises: a lower plate configured to be arranged below a lower blade of the slider; and a lower wall configured to surround a front side and right and left sides of an outer periphery of the lower blade and protruding upward from the lower plate, and wherein at least one of the upper mounting plate and the lower mounting plate comprises a protrusion protruding from an inner peripheral surface of at least corresponding one of the upper wall and the lower wall and configured to come in close contact with a part of an outer peripheral surface of at least corresponding one of the upper blade and the lower blade.

The phrase "at least one of the upper mounting plate and the lower mounting plate comprises a protrusion protruding from an inner peripheral surface of at least corresponding one of the upper wall and the lower wall and configured to come in close contact with a part of an outer peripheral surface of at least corresponding one of the upper blade and the lower blade" means the following three cases:

(1) a case where the upper mounting plate has the protrusion but the lower mounting plate does not have the protrusion;

(2) a case where the lower mounting plate has the protrusion but the upper mounting plate does not have the protrusion; and (3) a case where the upper mounting plate has the protrusion and the lower mounting plate also has the protrusion.

In the cases of the above (1) and (3), the protrusion of the upper mounting plate protrudes from the inner peripheral surface of the upper wall and comes in close contact with a part of the outer peripheral surface of the upper blade when the slider cover is mounted to the slider.

In the cases of the above (2) and (3), the protrusion of the lower mounting plate protrudes from the inner peripheral surface of the lower wall and comes in close contact with a part of the outer peripheral surface of the lower blade when the slider cover is mounted to the slider.

The upper wall is configured to protrude downward from the upper plate and a preferable example of specific arrangement thereof is as follows.

Namely, the upper wall may be configured to surround a front side and right and left sides of an outer periphery of the upper blade and to be arranged at a front side and right and left sides of the through-hole.

Whether the protrusion is provided in the upper mounting plate or the lower plate is not limited, and also the number of the protrusions is not limited. However, in order to stabilize a mounted state of the slider cover on the slider, the following (1) and (2) are preferable.

(1) The lower mounting plate may comprise, as the protrusion, a pair of lower protrusions protruding from the inner peripheral surface of the lower wall in a bilaterally symmetrical manner.

(2) In addition to the above (1), the upper mounting plate may comprise, as the protrusion, a pair of upper protrusions protruding from the inner peripheral surface of the upper wall in a bilaterally symmetrical manner.

In the case of the above (2), it is also possible to stabilize the mounted state of the slider cover on the slider using a shape of the slider. For example, if the upper blade of the slider has an upper narrowed portion configured so that a width thereof in the right and left direction is gradually narrowed rearward, the following (2-1) is preferable.

(2-1) The upper wall may comprise an upper front wall arranged at the front side of the through-hole, and a pair of upper side walls arranged at the right and left sides of the through-hole. The pair of upper side walls may be configured so that a distance therebetween in the right and left direction is gradually narrowed rearward. The pair of upper protrusions may protrude from the inner peripheral surface of the pair of upper side walls in the bilaterally symmetrical manner.

The slider cover as described above is designed in consideration of the slider on which the slider cover is to be mounted. A slider set according to an aspect of the embodiments of the present invention comprises the slider cover as described above and the slider mounted with the slider cover. The slider comprises the upper blade and the lower blade opposing the upper blade in the upward and downward direction, a guide post connecting a front portion of the upper blade and a front portion of the lower blade, a pull tab attachment portion protruding upward from the upper blade, and a pull tab attached to the pull tab attachment portion. The slider cover is configured so that the upper wall is formed into a shape following the upper blade with a gap interposed therebetween and the lower wall is formed into a shape following the lower blade with a gap interposed therebetween. The protrusion is in close contact with the at least corresponding one of the upper blade and the lower blade.

Also, in the slider set according to the aspect of the embodiments of the preset invention having the above configuration, if the slider cover according to the above (2-1) is used, the following is preferable in order to stabilize the mounted state of the slider cover on the slider.

Namely, the upper blade may have an upper narrowed portion configured so that a width thereof in the right and left direction is gradually narrowed rearward, the pair of upper protrusions may be in close contact with right and left surfaces of the upper narrowed portion, and the pair of lower protrusions may be in close contact with the lower blade.

When the slider cover according to the present invention is mounted on the slider, as the protrusion is in close contact with a part of the outer peripheral surface of the upper blade or the lower blade, the mounted state of the slider cover on the slider can be stabilized, as compared with a slider cover having no protrusion. Accordingly, the slider cover is hardly rattled when the slider is operated.

According to the slider cover in which the lower mounting plate comprises, as the protrusion, a pair of lower protrusions in a bilaterally symmetrical manner, the mounted state of the lower mounting plate on the lower blade can be further stabilized.

According to the slider cover in which the upper mounting plate comprises, as the protrusion, a pair of upper protrusions in a bilaterally symmetrical manner, the mounted state of the upper mounting plate on the upper blade can be further stabilized.

According to the slider cover in which the upper wall comprises the upper front wall and the pair of upper side walls, a distance between the pair of upper side walls in the right and left direction is gradually narrowed rearward, and the pair of upper protrusions protrude from the inner peripheral surface of the pair of upper side walls in the bilaterally symmetrical manner, if the upper blade of the slider on which the slider cover can be mounted has an upper narrowed portion configured so that a width thereof in the right and left direction is gradually narrowed rearward, as the pair of upper protrusions act to press the upper blade forward, while sandwiching the upper blade from the right and left sides thereof, it is possible to further stabilize the mounted state of the upper mounting plate on the upper blade in the front and rear direction. In addition, since the pair of lower protrusions come in close contact with the lower blade, the mounted state of the slider cover on the slider can be stabilized.

According to the slider set of the present invention, the same effects as those of the slider cover described above can be obtained.

DETAILED DESCRIPTION

Figure 11:
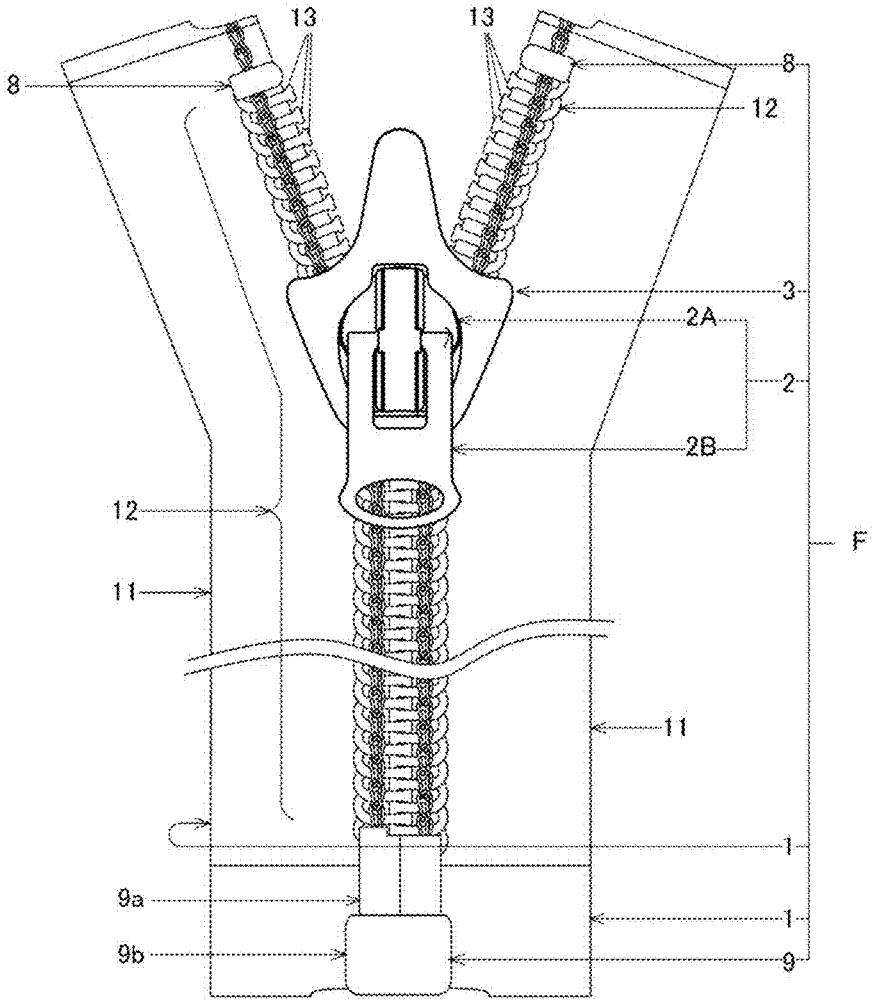
FIG. 11 is a plan view showing a slide fastener to which the slider cover according to the first embodiment of the present invention is applied.

As shown in FIG. 11, a slide fastener F, to which a slider cover 3 according to a first embodiment of the present invention is applied, includes a pair of fastener stringers 1, 1 extending parallel to each other, a slider 2 configured to be moveable along opposing side edge portions of the pair of fastener stringers 1, 1, a slider cover 3 mounted on the slider 2, and first and second stops 8 and 9 defining a range of movement for the slider 2 at both ends of the pair of fastener stringers 1, 1 in a length direction, along which the pair of fastener stringers 1, 1 extend. Herein, an assembly, in which the slider 2 and the slider cover 3 are integrally assembled to each other, is also referred to as a slider set.

In the following, when explaining directions, the length direction is also referred to as a front and rear direction. A front direction, which refers to an upward direction in FIG. 11, is a direction along which the slider 2 is moved to close the pair of fastener stringers 1, 1. A rear direction, which refers to a downward direction in FIG. 11, is a direction along which the slider 2 is moved to open the pair of fastener stringers 1, 1. Also, a right and left direction is a direction which is perpendicular to the length direction (front and rear direction) and also in which the pair of fastener stringers 1, 1 are arranged and also referred to as width direction. A left direction is a left direction in FIG. 11 and a right direction is a right direction in FIG. 11. Further, a direction perpendicular to the front and rear direction and the right and left direction is referred to as an upward and downward direction (thickness direction). An upward direction is a direction, which is oriented to a near side, of directions perpendicular to the paper surface of FIG. 11, i.e., directions perpendicular to the front and rear direction and the right and left direction. A downward direction is a direction, which is oriented to a far side, of directions perpendicular to the paper surface of FIG. 11.

The pair of fastener stringers 1, 1 includes a pair of tapes 11, 11, extending in the front and rear direction and arranged in the right and left direction, and a pair of element rows 12, 12 fixed along opposing side edge portions of the pair of tapes 11, 11.

Each of the tapes 11 has a shape of a band elongated in the front and rear direction, and a thickness direction thereof is the upward and downward direction.

Each of the element rows 12 is formed by a plurality of elements 13 arranged in a row along the respective opposing side edge portions of the tapes 11. The plurality of elements 13 may be a continuous monolithic body or may be individually separated.

If the slider 2 is moved forward to close the pair of fastener stringers 1, 1, elements 13, 13 of the pair of element rows 12, 12, respectively, are engaged with each other, and upon collision of the slider 2 against the first stops 8, a further forward movement of the slider 2 is prevented. Also, if the slider 2 is moved rearward to open the pair of fastener stringers 1, 1, elements 13, 13 of the pair of element rows 12, 12, respectively, are separated into right and left sides, and upon collision of the slider 2 against the second stop 9, a further rearward movement of the slider 2 is prevented.

Figure 3:
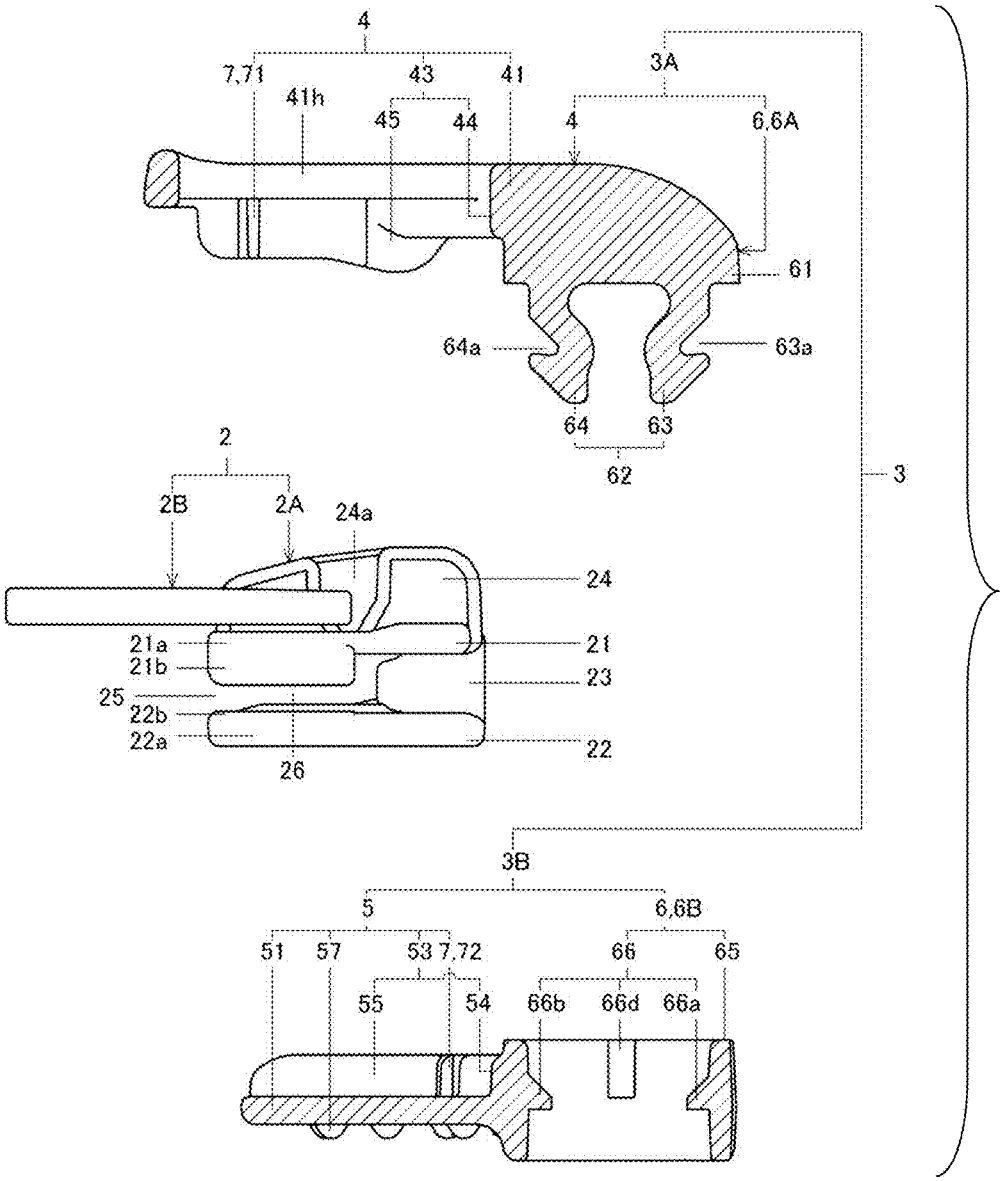
FIG. 3 is a side view showing a state before the slider cover according to the first embodiment of the present invention is mounted on the slider.

The slider 2 includes a slider body 2A configured to be engaged with the pair of element rows 12, 12 and to be movable in the front and rear direction, and a pull tab 2B connected to the slider body 2A (see FIG. 3).

Figure 1:
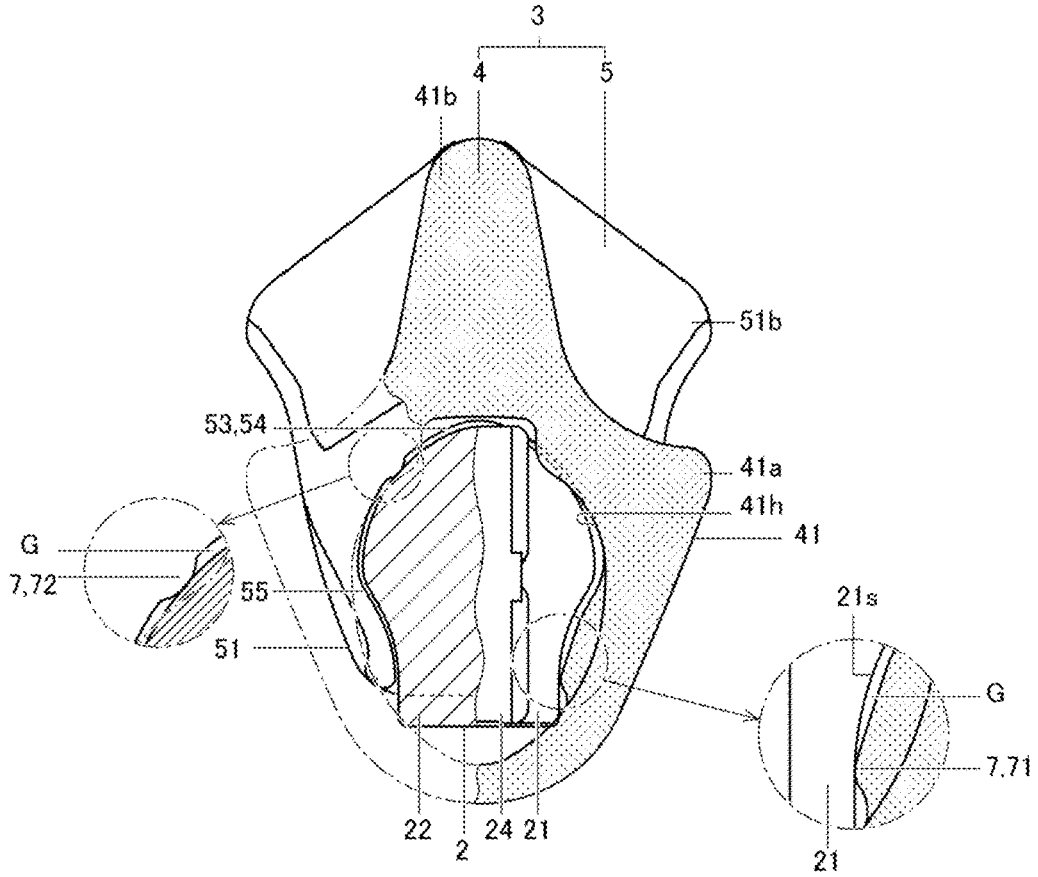
FIG. 1 is an explanatory view showing a slider set in a state where a slider cover according to a first embodiment of the present invention is mounted on a slider, as viewed from above.
Figure 2:
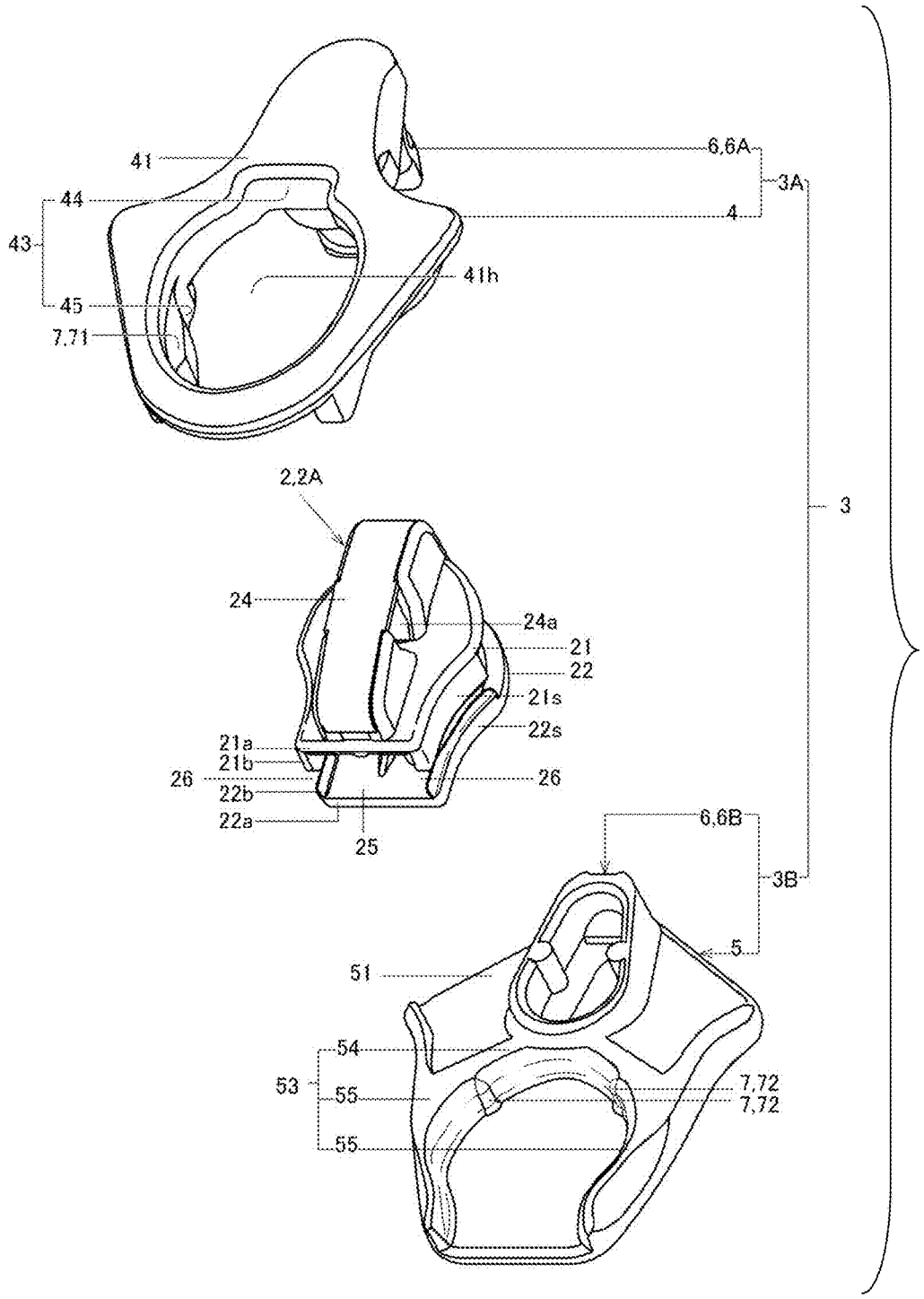
FIG. 2 is a perspective view showing a state before the slider cover according to the first embodiment of the present invention is mounted on the slide.

As shown in FIGS. 1 to 3, the slider body 2A includes an upper blade 21 and a lower blade 22 opposing each other in the upward and downward direction with a space interposed therebetween; a guide post 23 connecting between opposing front portions of the upper blade 21 and the lower blade 22 at the middle thereof in the right and left direction and configured to guide the pair of element rows 12, 12; and a pull tab attachment portion 24 protruding from an upper surface of the upper blade 21.

The upper blade 21 and the lower blade 22 includes, respectively, an upper blade body 21*a* and a lower blade body 22*a* opposing each other in the upward and downward direction and having a shape of a plate, and a flange portion 21*b*, 22*b* protruding from at least one end portion (both end portions in the shown example) of the upper blade body 21*a* and the lower blade body 22*a* in the upward and downward direction to reduce a gap therebetween.

The upper blade body 21*a* has such a bilaterally symmetrical shape that a front surface thereof bulges out in a generally circular arc shape and the middle portion of the front surface in the width direction protrudes most forward. Also, the upper blade body 21*a* is configured so that a width between right and left surfaces of a front portion thereof in the right and left direction is gradually narrowed as they go rearward and also a width between right and left surfaces of a rear portion thereof in the right and left direction is generally uniform.

In other words, as viewed in a top view, the external shape of the upper blade body 21*a* has such a shape that a width thereof is gradually expanded as it goes rearward from an end thereof, is gradually narrowed as it goes further rearward from a location thereon where the width is most expanded, (location corresponding generally to the middle of the entire length thereof in the front and rear direction), and then after the width is narrowed to some extent, is generally uniform as it goes up to a rear end thereof. Herein, in the external shape of the upper blade body 21*a*, the location where the width is most expanded is a boundary between the front surface and the side surfaces of the upper blade body 21*a*.

Since the upper flange portions 21*b* protrude downward from the upper blade body 21*a*, a shape thereof is configured to correspond to right and left side surfaces of the upper blade body 21*a*.

In this way, shapes of the upper blade body 21*a* and the upper flange portions 21*b* correspond to each other. Herein, a portion, in which a width in the right and left direction is gradually narrowed as it goes rearward, of the upper blade 21 having the upper blade body 21*a* and the upper flange portions 21*b* is referred to as an upper narrowed portion 21*s*.

The lower blade 22 has a generally vertically symmetrical shape with the upper blade 21. Accordingly, a portion, in which a width in the right and left direction is gradually narrowed as it goes rearward, of the lower blade 22 (i.e., of the lower blade body 22*a* and the lower flange portions 22*b*) is referred to as a lower narrowed portion 22*s*.

The pull tab attachment portion 24 has a through-hole 24*a* formed to penetrate therethrough in the right and left direction. Also, a portion of the pull tab 2B is inserted through the through-hole 24*a*, so that the pull tab 2B is connected to the slider body 2A.

In addition, the slider body 2A has, as an inner space thereof, an element passage 25 and a pair of tape grooves 26, 26. The element passage 25 allows the pair of element rows 12, 12 to pass therethrough and each of the tape grooves 26 allows the corresponding tape 11 to pass therethrough.

The element passage 25 extends between the upper blade 21 and the lower blade 22 in the front and rear direction and is bifurcated at a front portion thereof by the guide post 23.

The pair of tape grooves 26, 26 are communicated with the element passage 25 and are respectively opened in the right and left direction between the upper blade 21 and the lower blade 22 on the right and left side portions thereof.

As shown in FIG. 11, the first stops 8 are individually fixed to the respective tapes 11 on the front side of the pair of element rows 12, 12.

In the shown example, the second stop 9, which is also referred to as a so-called separable end stop, has a separable pin 9*a* fixed to one of the two tapes 11 and a retainer box 9*b* fixed to the other.

As shown in FIGS. 2 and 3, the slider cover 3 according to the first embodiment of the present invention is constituted of two members, i.e., an upper member 3A and a lower member 3B configured to be mounted on upper and lower sides of the slider 2, respectively, and is integrally assembled by connecting front portions of the upper member 3A and the lower member 3B to each other in the upward and downward direction. Also, the assembly of the upper member 3A and the lower member 3B includes an upper mounting plate 4 to be mounted on the upper side of the slider 2, a lower mounting plate 5 to be mounted on the lower side of the slider 2, and a column-shaped connecting post 6 connecting front portions of the upper mounting plate 4 and the lower mounting plate 5 on the front side of the slider 2.

The upper member 3A has the upper mounting plate 4 and an upper connecting post 6A, which becomes an upper portion of the connecting post 6. The upper connecting post 6A is configured to protrude downward from the middle of a width, in the right and left direction, of the front portion of the upper mounting plate 4 and also to be connected to the front portion of the lower member 3B.

As shown in FIGS. 2, 3, 7A, 7B, 8A and 8B, the upper mounting plate 4 includes an upper plate 41 configured to be arranged above the upper blade 21 of the slider 2, and having a through-hole 41*h* formed to penetrate therethrough in the upward and downward direction in order to allow the pull tab attachment portion 24 and the pull tab 2B of the slider 2 to pass therethrough; an upper wall 43 configured to surround a front side and right and left sides of the outer periphery of the upper blade 21 and to protrude downward from the upper plate 41 on a front side and right and left sides of the through-hole 41*h*; and a pair of protrusions 7, 7 configured to protrude from an inner peripheral surface of the upper wall 43 and to come in close contact with parts of the outer peripheral surface of the upper blade 21. Meanwhile, protrusions 7 are also provided on the lower mounting plate 5 as well as the upper mounting plate 4, and accordingly, if it is necessary to distinguish from one another for convenience of explanation, protrusions 7 of the upper mounting plate 4 are referred to as upper protrusions 71 and protrusions 7 of the lower mounting plate 5 are referred to as lower protrusions 72.

The upper plate 41 is configured to be longer in the front and rear direction and the right and left direction than the external shape of the slider 2. More specifically, the upper plate 41 includes an upper plate main portion 41*a* configured to be placed on the upper blade 21 and an upper plate sub-portion 41*b* configured to protrude forward from the middle portion, in the right and left direction, of the upper plate main portion 41*a*. In addition, the upper plate main portion 41*a* has a shape longer in the front and rear direction and the right and left direction than the upper blade 21 and is configured so that a lower surface thereof becomes a horizontal surface extending in the front and rear direction and the right and left direction.

Also, the through-hole 41*h* penetrate through the upper plate main portion 41*a* in the upward and downward direction and has such a generally elliptical shape that a length in the front and rear direction is longer than a length in the right and left direction. Further, the through-hole 41*h* is smaller than the external shape of the upper blade 21 and thus is formed in a shape preventing the upper blade 21, which is arranged below the upper plate 41, from passing upward therethrough, but allowing the pull tab attachment portion 24 and the pull tab 2B to pass therethrough. By the way, in the example of FIGS. 6A and 6B, an inner peripheral portion of the upper plate 41, which defines an outer periphery of the through-hole 41*h*, is configured to press front and rear portions of the upper blade 21 from above, but at two locations for each in a bilaterally symmetrical manner, in a state where the pull tab attachment portion 24 is received in the inside thereof (through-hole 41*h*). Namely, four pressing portions 41*a*1 on the inner periphery of the upper plate 41, which are configured to press the upper blade 21 from above, are arranged to be spaced from each other in a circumferential direction of the through-hole 41*h*.

The upper wall 43 includes an upper front wall 44 configured to protrude downward from the upper plate 41 on the front side of the through-hole 41*h*, and a pair of upper side walls 45, 45 configured to protrude further downward from the upper plate 41 on the right and left sides of the through-hole 41*h* than the upper front wall 44.

A rear surface of the upper front wall 44 and inner peripheral surfaces of the pair of upper side walls 45, 45 (i.e., a left surface of the right upper side wall 45 and a right surface of the left upper side walls 45) protrude downward to be substantially perpendicular to the lower surface of the upper plate 41. In addition, the upper front wall 44 is chamfered at a corner between the rear surface and a lower surface thereof, and similarly the pair of upper side walls 45, 45 are chamfered at a corner between the inner peripheral surface and a lower surface thereof.

The upper front wall 44 and the pair of upper side walls 45, 45 are configured to cooperatively surround the outer peripheral surface of the upper blade 21 along the front side and right and left sides thereof with a small gap G interposed therebetween, but not to surround the rear side of the outer peripheral surface of the upper blade 21 so that the rear side is opened.

Figure 6A:
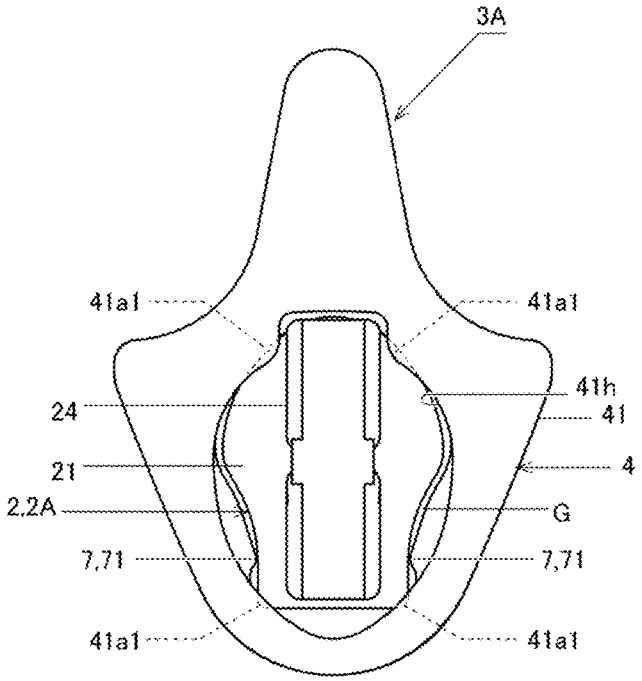
FIGS. 6A and 6B are a plan view and a bottom view showing a relationship between an upper mounting plate and an upper blade.
Figure 6B:
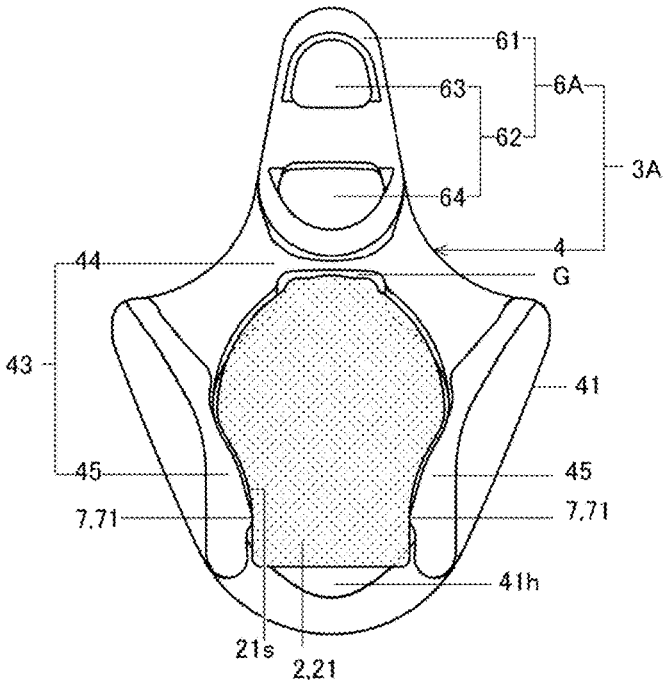
Figure 7A:
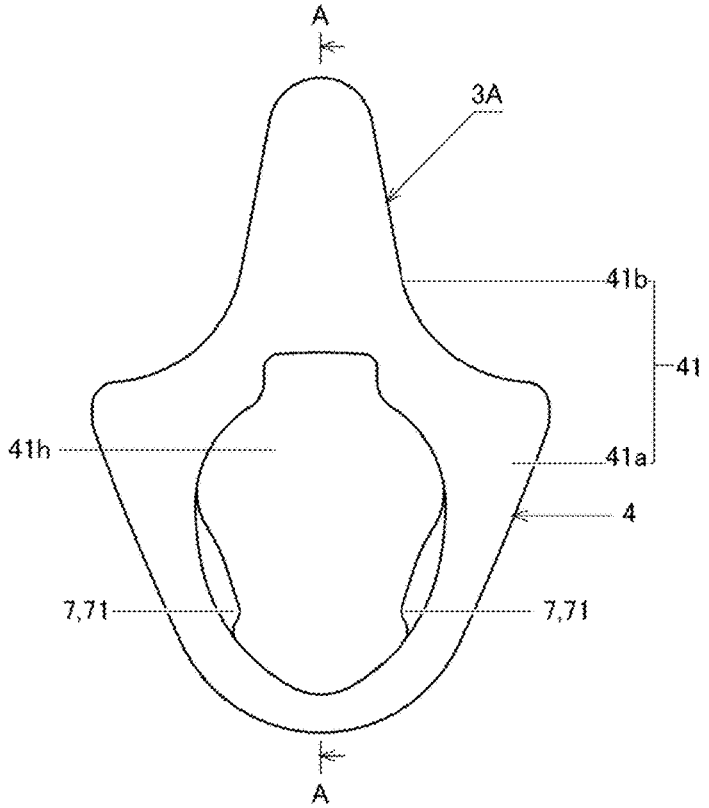
FIGS. 7A and 7B are a plan view and a bottom view showing an upper member.
Figure 7B:
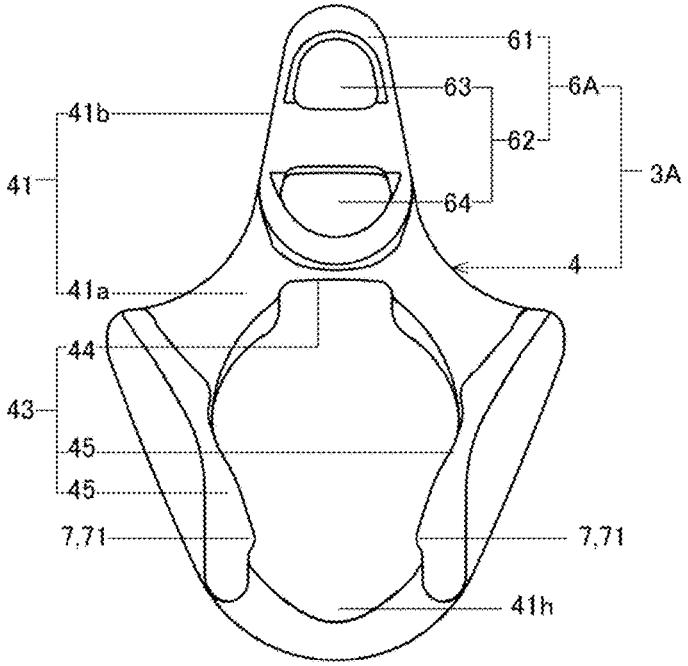
Figure 8A:
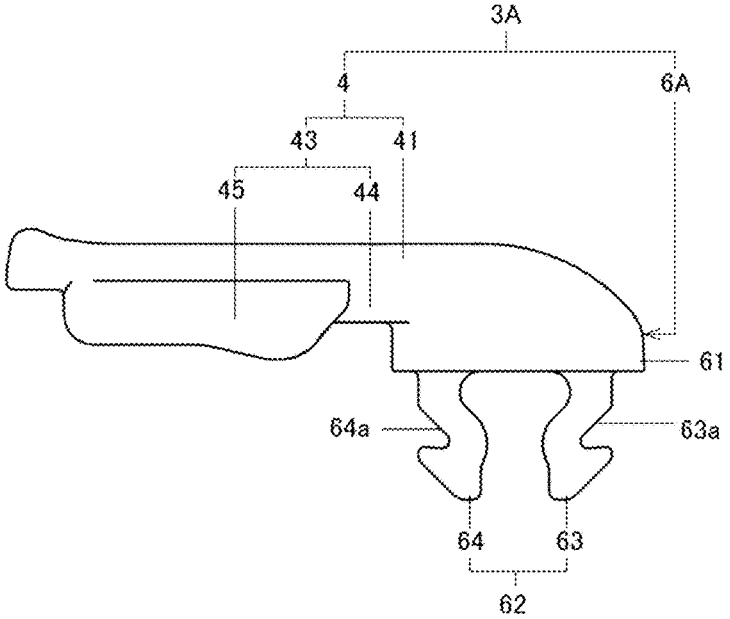
FIGS. 8A and 8B are a side view showing the upper member and a sectional view thereof taken along a line A-A of FIG. 7A.
Figure 8B:
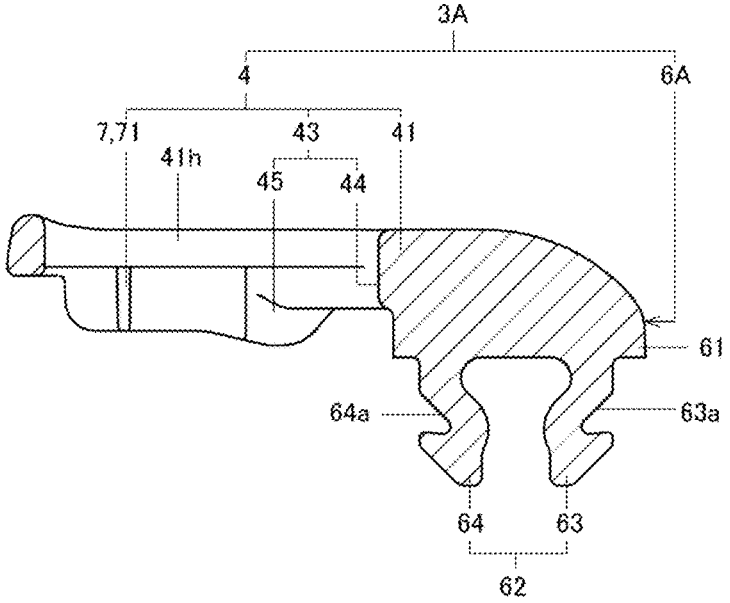
Figure 9A:
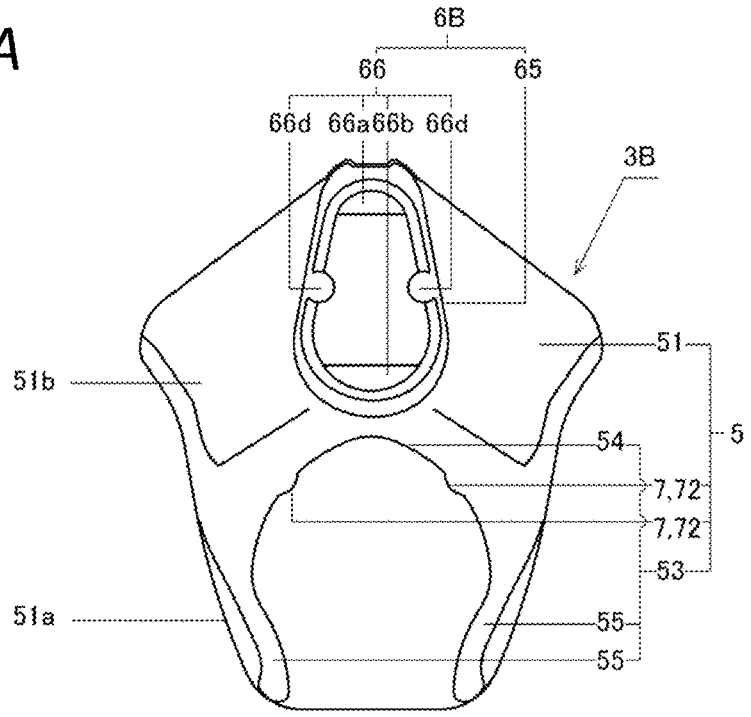
FIGS. 9A and 9B are a plan view and a front view showing a lower member.
Figure 9B:
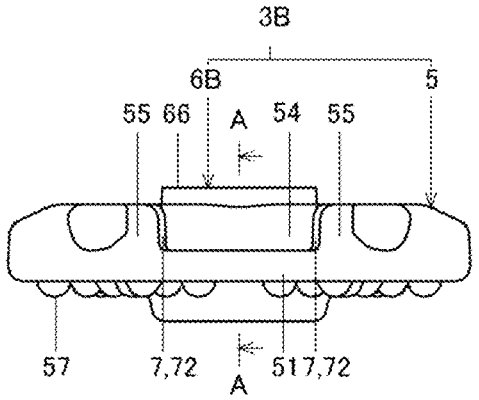
Figure 10A:
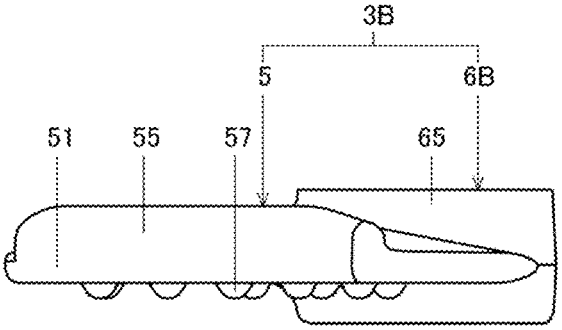
FIGS. 10A and 10B are a side view showing the lower member and a sectional view thereof taken along a line A-A of FIG. 9B.
Figure 10B:
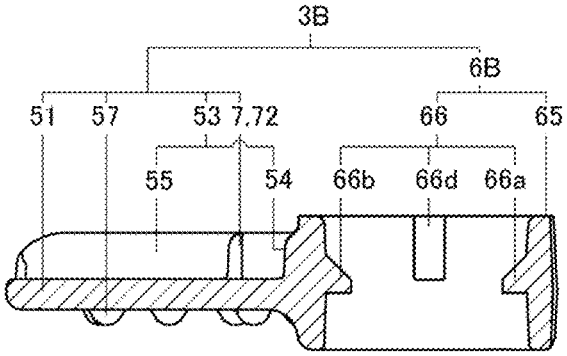

The upper front wall 44 is configured to surround the front side of the outer periphery of the upper blade body 21*a* with the gap G interposed therebetween. Therefore, as shown in FIGS. 6A and 6B, the rear surface of the upper front wall 44 has a shape following a front surface of the outer peripheral surface of the upper blade 21, more specifically a shape (generally semi-circular shape in the example of FIGS. 6A and 6B) similar to but slightly larger than that of the front surface of the upper blade 21, thereby restricting the upper blade 21 from moving forward.

The pair of upper side walls 45, 45 are configured to continuously extend rearward from rear ends of the upper front wall 44 and thus to surround the right and left sides of the outer periphery of the upper blade body 21*a* and the upper flange portions 21*b* with the gap G interposed therebetween. Also, the pair of upper side walls 45, 45 protrude further downward from the upper plate 41 than the upper front wall 45.

More specifically, the pair of upper side walls 45, 45 extend over a range from a front end of the upper plate 41 up to locations slightly in front of a rear end of the through-hole 41*h* along right and left end portions of the upper plate 41. Also, rear portions of the pair of upper side walls 45, 45 surround the right and left sides of the outer periphery of the upper blade body 21*a* and the upper flange portions 21*b* with the gap G interposed therebetween. Further, front portions of the pair of upper side walls 45, 45 are configured to be gradually apart from the upper blade 21 and thus to gradually increase a distance therebetween in the right and left direction as they go forward.

The inner peripheral surfaces of the rear portions of the pair of upper side walls 45, 45 (i.e., a right surface of the rear portion of the left upper side wall 45 and a left surface of the rear portion of the right upper side wall 45) have a shape following right and left surfaces of the outer peripheral surface of the upper blade 21 (right and left surfaces of the upper narrowed portion 21*s*), more specifically a shape similar to but slightly larger than that of the right and left surfaces of the upper blade 21. Namely, the pair of upper side walls 45, 45 have such a shape that a distance between the inner peripheral surfaces thereof in the right and left direction is gradually narrowed as they go rearward. By the way, in the shown example, the upper side walls 45 have a shape protruding to bulge further inward in the right and left direction than the inner peripheral surface of the though-hole 41*h*. Due to such a shape, the upper blade 21 is restricted to be substantially immovable in the right and left direction and also is restricted from moving rearward.

On the other hand, outer surfaces of the pair of upper side walls 45, 45 (i.e., a right surface of the right upper side wall 45 and a left surface of the left upper side wall 45) are formed to be recessed inward in the right and left direction relative to right and left surfaces of the upper plate 41. Further, rear ends of the pair of upper side walls 45 45 are separated from each other in the right and left direction and thus a space portion between the pair of upper side walls 45, 45 opens rearward.

As shown in FIGS. 6A, 6B, 7A and 7B, the pair of upper protrusions 71, 71 are configured to protrude from respective inner peripheral surfaces of the pair of upper side walls 45, 45 in a bilaterally symmetrical manner and thus to come in close contact with parts of the outer peripheral surface of the upper blade 21. More specifically, the left upper protrusion 71 protrudes from the middle portion, in the front and rear direction, of the right surface of the left upper side wall 45, which is the inner peripheral surface thereof, toward the right side, and the right upper protrusion 71 protrudes from the middle portion, in the front and rear direction, of the left surface of the right upper side wall 45, which is the inner peripheral surface thereof, toward the left side. In the shown example, as viewed in the upward and downward direction, the upper protrusions 71 protrude in a V-shape from a middle of the entire length, in the front and rear direction, of the upper side walls 45. In addition, the inner peripheral surfaces of the upper side walls 45 and the inner peripheral surfaces of the upper protrusions 71 are formed in a smoothly continued shape, and as a result, the upper protrusions 71 have a shape as if being a part of the upper side walls 45. Also, in terms of a length in the upward and downward direction, the upper protrusions 71 are formed over the enter length of the upper side walls 45 in the upward and downward direction.

Further, a distance between the pair of upper protrusions 71, 71 in the right and left direction is set so that the narrowest distance therebetween is slightly narrower than a width dimension, in the right and left direction, of the corresponding portion of the upper narrowed portion 21*s* of the upper blade 21.

As shown in FIGS. 2 and 3, the lower member 3B has the lower mounting plate 5 and a lower connecting post 6B, which becomes a lower portion of the connecting post 6. The lower connecting post 6B is configured to protrude both upward and downward from the middle of a width, in the right and left direction, of the front portion of the lower mounting plate 5 and also to be connected to the upper connecting post 6A, which is the front portion of the upper member 3A.

As shown in FIGS. 2, 3, 9A, 9B, 10A and 10B, the lower mounting plate 5 includes a lower plate 51 configured to be arranged below the lower blade 22 of the slider 2; an upper wall 53 configured to surround a front side and right and left sides of the outer periphery of the lower blade 22 and to protrude upward from the lower plate 51; a pair of lower protrusions 72, 72 as the protrusions 7, 7 configured to protrude from an inner peripheral surface of the lower wall 53 and to come in close contact with parts of the outer peripheral surface of the lower blade 22; and a plurality of bumps 57 configured to protrude downward from a lower surface of the lower wall 53.

As viewed in a plan view, the lower plate 51 is of a bilaterally symmetrical shape and has right and left sides, a rear side connecting rear ends of the right and left sides, and a front side connecting front ends of the right and left sides. The front side is inclined with respect to the right and left direction so that the front side is oriented rearward as its goes from the middle thereof in the right and left direction toward both ends in the right and left direction. The right and left sides are inclined with respect to the front and left direction so that the right and left sides are oriented toward the middle in the right and left direction as they go from the front ends toward the rear ends. The rear side is parallel to the right and left direction.

Also, the lower plate 51 is divided into a rear portion referred to as a lower plate main portion 51*a*, on which the lower blade 22 is placed, and a front portion (portion located further forward than the lower plate main portion 51*a*) referred to as a lower plate sub-portion 51*b*, on which the pair of element rows 12, 12 are placed. An upper surface of the lower plate main portion 51*a* is a horizontal surface extending in the front and rear direction and the right and left direction.

The lower plate sub-portion 51*b* protrudes forward from the entire front surface, in the right and left direction, of the lower plate main portion 51*a*. Also, as viewed in a plan view of the slide cover 3 in a state where the upper member 3A and the lower member 3B are connected to each other, the lower plate sub-portion 51*b*, as shown in FIG. 1, protrudes in the right and left direction relative to the upper plate sub-portion 41*b* and also protrudes forward relative to the upper plate main portion 41*a*.

The lower wall 53 includes a lower front wall 54 configured to protrude upward from the lower plate 51 on the front side of a site, on which the lower blade 22 is placed, and a pair of lower side walls 55, 55 configured to protrude upward from the lower plate 51 on the right and left outside of the site, on which the lower blade 22 is placed.

A rear surface of the lower front wall 54 and inner peripheral surfaces of the pair of lower side walls 55, 55 (i.e., a left surface of the right lower side wall 55 and a right surface of the left lower side walls 55) protrude upward to be substantially perpendicular to the upper surface of the lower plate 51. The lower side walls 55 protrude from the lower plate 51 to substantially the same extent as the lower front wall 55. In addition, the lower front wall 54 is chamfered at a corner between the rear surface and an upper surface thereof, and similarly the pair of upper side walls 55, 55 are chamfered at a corner between the inner peripheral surface and an upper surface thereof.

The lower front wall 54 and the pair of lower side walls 55, 55 are configured to cooperatively surround the outer peripheral surface of the lower blade 22 along the front side and right and left sides thereof with a small gap G interposed therebetween, but not to surround the rear side of the outer peripheral surface of the lower blade 22 so that the rear side is opened.

Figure 5:
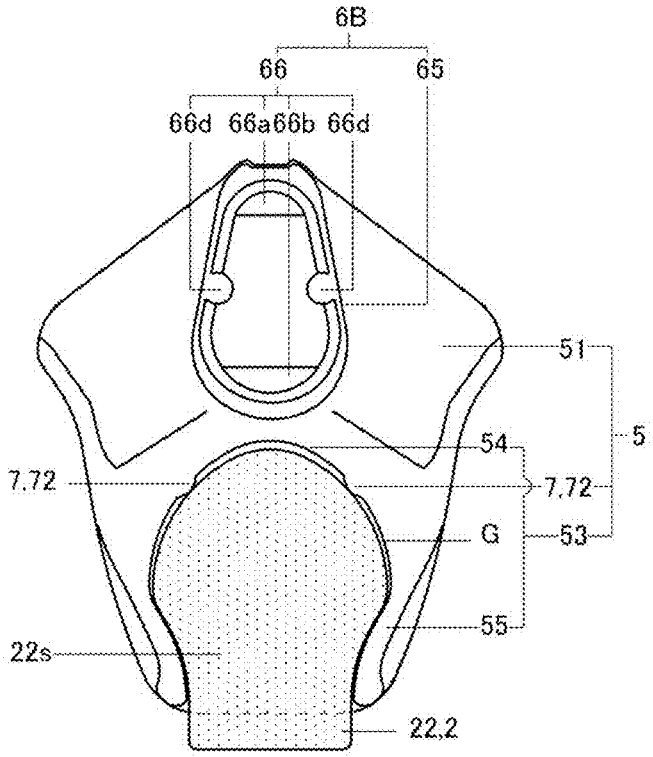
FIG. 5 is a plan view showing a relationship between a lower mounting plate and a lower blade.

The lower front wall 54 is configured to surround the front side of the outer periphery of the lower blade body 22*a* with the gap G interposed therebetween. Therefore, as shown in FIG. 5, the rear surface of the lower front wall 54 has a shape following a front surface of the outer peripheral surface of the lower blade 22, more specifically a shape (generally semi-circular shape in the example of FIG. 5) similar to but slightly larger than that of the front surface of the lower blade 22, thereby restricting the lower blade 22 from moving forward.

The pair of lower side walls 55, 55 are configured to continuously extend rearward from rear ends of the lower front wall 54 and thus to surround the right and left sides of the outer periphery of the lower blade body 22*a* and the lower flange portions 22*b* with the gap G interposed therebetween. Also, upper ends of the pair of lower side walls 55, 55 are positioned at the same level as an upper end of the lower front wall 55.

The inner peripheral surfaces of the pair of lower side walls 55, 55 (i.e., a right surface of the left lower side wall 45 and a left surface of the right lower side wall 55) have a shape following right and left surfaces of the outer peripheral surface of the lower blade 22 (right and left surfaces of the upper narrowed portion 21*s*), more specifically a shape similar to but slightly larger than that of the right and left surfaces of the lower blade 22. Namely, the pair of lower side walls 55, 55 have such a shape that a distance between the inner peripheral surfaces thereof in the right and left direction is gradually narrowed as they go rearward. Due to such a shape, the lower blade 22 is restricted to be substantially immovable in the right and left direction and also is restricted from moving rearward.

Also, in terms of a length in the front and rear direction, the pair of lower side walls 55, 55 extend along the right and left end portions of the lower plate 51 over the entire length thereof.

As shown in FIGS. 9A, 9B, 10A and 10B, the pair of lower protrusions 72, 72 are configured to protrude from respective inner peripheral surfaces of the pair of lower side walls 55, 55 in a bilaterally symmetrical manner and thus to come in close contact with parts of the outer peripheral surface of the lower blade 22. More specifically, the pair of lower protrusions 72, 72 protrude from the middle portion, in the right and left direction, of a rear surface of the lower front wall 54, which is an inner peripheral surface thereof, toward the rear side in a bilaterally symmetrical manner. In the shown example, as viewed in a plan view, the lower protrusions 72 have a circular arc shape. Further, in terms of a length in the upward and downward direction, the lower protrusions 72 are formed over the entire length, in the upward and downward direction, of the lower side walls 55.

As shown in FIG. 3, the connecting post 6 is formed by the upper connecting post 6A and the lower connecting post 6B.

The upper connecting post 6A protrudes downward from a front portion (portion located further forward than a site by which the upper blade 21 is covered) of the upper plate 41 and has a column-shaped upper post 61 extending downward form the upper plate 41 and an upper connection portion 62 extending downward from the middle portion of a lower end surface of the upper post 61.

The lower connecting post 6B has a cylindrical lower post 65 protruding upward and downward from the middle portion, in the right and left direction, of a front portion (portion located further forward than the site on which the lower blade 22 is placed) of the lower plate 51, and a lower connection portion 66 formed in an inner peripheral surface of the lower post 66 and configured to be connected to the upper connection portion 62.

The lower post 65 is configured to be opened at upper and lower sides thereof. Also, the lower post 65 and the upper post 61 is configured so that when the upper member 3A the lower member 3B are connected to each other, a upper surface of the lower post 65 and the lower surface of the upper post 61 butt against each other in the upward and downward direction.

The upper connection portion 62 and the lower connection portion 66 are configured to be connected to each other by engaging concave portions with convex portions.

As shown in FIGS. 7A, 7B, 8A and 8B, the upper connection portion 62 includes front and rear small posts 63, 64 protruding downward from the lower end surface of the upper post 61 while being spaced from each other in the front and drear direction, a front recess 63*a* formed to be recessed rearward on a front surface of the front small post 63, and a rear recess 64*a* formed to be recessed forward on a rear surface of the rear small post 64.

As shown in FIGS. 9A, 9B, 10A and 10B, the lower connection portion 66 includes front and rear plate-shaped projections 66*a*, 66*b* projecting, respectively, forward and rearward from the inner peripheral surface of the lower post 65, and a pair of guide portions 66*d*, 66*d* projecting laterally from respective right and left surfaces of the inner peripheral surface of the lower post 65. The front projection 66*a* and the front recess 63*a* are engaged with each other and also the rear projection 66*b* and the rear recess 64*a* are engaged with each other, thereby connecting the upper connecting post 6A with the lower connecting post 6B. Also, the pair of guide portions 66*d*, 66*d* are sandwiched between the front small post 63 and the rear small post 64, thereby ensuring a strong and firm connection between the upper connecting post 6A and the lower connecting post 6B. In this way, the connecting post 6 is formed and thus the upper member 3A and the lower member 3B are integrally assembled.

Figure 4:
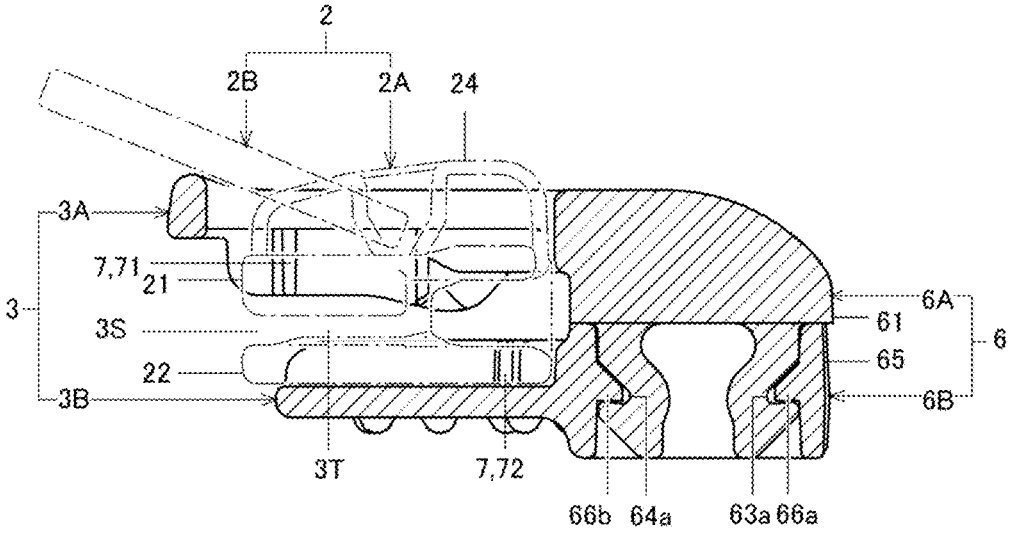
FIG. 4 is a sectional view showing a state when the slider cover according to the first embodiment of the present invention is mounted on the slider.

As shown in FIG. 4, the assembly of the upper member 3A and the lower member 3B include, as an inner spaces, a formed-in-cover element passage 3S formed between the upper mounting plate 4 and the lower mounting plate 5, which like the element passage 25 of the slider 2, defines two passages on the right and left sides of the connecting post 6 and one passages on the rear side of the connecting post 6.

Also, the assembly of the upper member 3A and the lower member 3B has a pair of formed-in-cover tape grooves 3T formed between the upper mounting plate 4 and the lower mounting plate 5 on right and left end portions thereof, respectively, to be communicated with the formed-in-cover element passage 3S. The formed-in-cover element passage 3S allows the pair of element rows 12, 12 to pass therethrough and each of the formed-in-cover tape grooves 3T allows the corresponding tape 11 to pass therethrough.

If the slider cover 3 of the first embodiment described above is mounted on the slider 2 on which the slider cover 3 is considered to be attached as shown in FIG. 1, the protrusions 7 (upper protrusions 71) of the upper plate 41 are in close contact with parts of the front surface of the upper blade 21 and the protrusions 7 (lower protrusions 72) of the lower plate 51 are in close contact with parts of the right and left surfaces of the lower blade 22. Accordingly, as compared with a slider cover 3 which has no protrusion, a mounted state of the slider cover 3 on the slider 2 can be stabilized and thus the slider cover 3 is hardly rattled when the slider 2 is operated.

In addition, the pair of upper protrusions 71, 71 are in close contact with the upper mounting plate 4 from the right and left side thereof in a bilaterally symmetrical manner, and also the pair of lower protrusions 72, 72 are in close contact with the lower mounting plate 5 from the right and left sides thereof in a bilaterally symmetrical manner. As a result, a mounted state of the upper mounting plate 4 on the upper blade 21 and a mounted state of the lower mounting plate 5 on the lower blade 22 can be further stabilized.

Further, a distance, in the right and left direction, between the pair of upper side walls 45, 45 of the upper wall 43 is gradually narrowed as they go rearward to correspond to a shape of the upper narrowed portion 21*s* of the upper blade 21 of the slider 2. Accordingly, the pair of upper protrusions 71, 71 act to press the upper blade 21 forward, while sandwiching the upper blade 21 from the right and left sides thereof, thereby further stabilizing the mounted state of the upper mounting plate 4 on the upper blade 21 in the front and rear direction.

Further, the slider set, in which the slider cover 3 and the slider 2 are integrally assembled to each other, can also obtain the same effects as those of the slider cover 3 described above.

Figure 12:
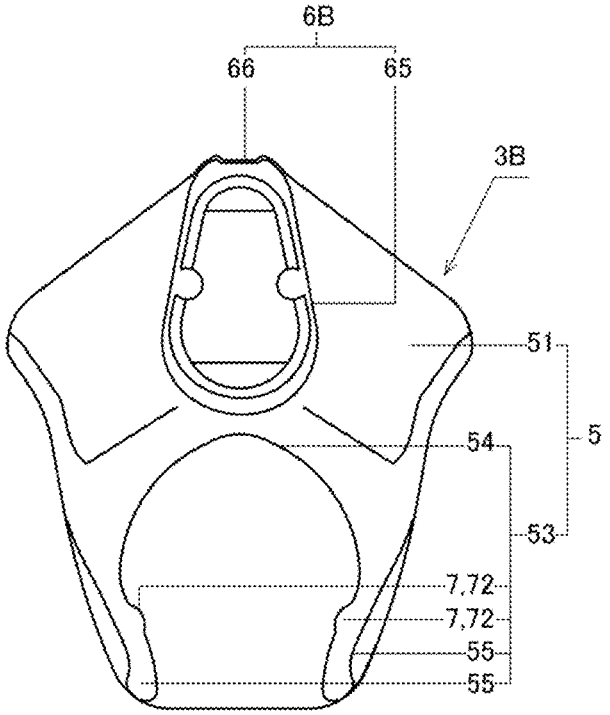
FIG. 12 is a plan view showing a lower member applied to a slider cover according to a second embodiment of the present invention.

A slider cover 3 according to a second embodiment of the present invention corresponds to the slider cover 3 of the first embodiment, except that as shown in FIG. 12, a lower member 3B is configured to be different from that of the slider cover 3 of the first embodiment. More specifically, a pair of lower protrusions 72, 72 are formed on inner surfaces of a pair of lower side walls 55, 55 in a bilaterally symmetrical manner.

The present invention is not limited to the foregoing embodiments. For example, although in the foregoing embodiments, the slider cover 3 is constituted of the upper member 3A and the lower member 3B as separate components, i.e., two components, the slider cover 3 may be constituted of a single component, in which the upper mounting plate 4, the lower mounting plate 5 and the connecting post 6 are integrally formed with each other. In this case, the connecting post 6 is connected to the upper mounting plate 4 and the lower mounting plate 5 at upper and lower ends thereof, respectively.

What is claimed is:

1. A slider cover of a slide fastener, comprising:

an upper mounting plate configured to be mounted on an upper side of a slider;

a lower mounting plate configured to be mounted on a lower side of the slider; and a column-shaped connecting post connecting a front portion of the upper mounting plate and a front portion of the lower mounting plate at a front side of the slider, wherein the upper mounting plate comprises: an upper plate configured to be arranged above an upper blade of the slider and formed with a through-hole penetrating through the upper mounting plate in an upward and downward direction in order to allow a pull tab of the slider to pass through the through-hole; and an upper wall protruding downward from the upper plate, wherein the lower mounting plate comprises: a lower plate configured to be arranged below a lower blade of the slider; and a lower wall configured to surround a front side and right and left sides of an outer periphery of the lower blade and protruding upward from the lower plate, and wherein the upper mounting plate comprises a protrusion protruding from an inner peripheral surface of the upper wall and configured to come in close contact with a part of an outer peripheral surface of the upper blade.

2. The slider cover according to claim 1, wherein the upper wall is configured to surround a front side and right and left sides of an outer periphery of the upper blade and to be arranged at a front side and right and left sides of the through-hole.

3. The slider cover according to claim 1, wherein the lower mounting plate comprises a pair of lower protrusions protruding from the inner peripheral surface of the lower wall in a bilaterally symmetrical manner.

4. The slider cover according to claim 3, wherein the protrusion on the upper wall comprises a pair of upper protrusions protruding from the inner peripheral surface of the upper wall in a bilaterally symmetrical manner.

5. The slider cover according to claim 4, wherein the upper wall comprises an upper front wall arranged at the front side of the through-hole, and a pair of upper side walls arranged at the right and left sides of the through-hole, wherein the pair of upper side walls are configured so that a distance therebetween in a right and left direction is gradually narrowed rearward, and wherein the pair of upper protrusions protrude from the inner peripheral surface of the pair of upper side walls in the bilaterally symmetrical manner.

6. A slider set comprising the slider cover according to claim 1, and the slider mounted with the slider cover, wherein the slider comprises: the upper blade; the lower blade opposing the upper blade in the upward and downward direction; a guide post connecting a front portion of the upper blade and a front portion of the lower blade; a pull tab attachment portion protruding upward from the upper blade; and a pull tab attached to the pull tab attachment portion, wherein the slider cover is configured so that the upper wall is formed into a shape following the upper blade with a gap interposed therebetween and the lower wall is formed into a shape following the lower blade with a gap interposed therebetween, and wherein the protrusion is in close contact with the upper blade.

7. A slider set comprising the slider cover according to claim 5, and the slider mounted with the slider cover, wherein the slider comprises: the upper blade; the lower blade opposing the upper blade in the upward and downward direction; a guide post connecting a front portion of the upper blade and a front portion of the lower blade; a pull tab attachment portion protruding upward from the upper blade; and a pull tab attached to the pull tab attachment portion, wherein the upper blade has an upper narrowed portion configured so that a width thereof in the right and left direction is gradually narrowed rearward, wherein the slider cover is configured so that the upper wall is formed into a shape following the upper blade with a gap interposed therebetween and the lower wall is formed into a shape following the lower blade with a gap interposed therebetween, wherein the pair of upper protrusions are in close contact with right and left surfaces of the upper narrowed portion, and wherein the pair of lower protrusions are in close contact with the lower blade.

8. A slider cover of a slide fastener, comprising:

an upper mounting plate configured to be mounted on side of a slider;

a lower mounting plate configured to be mounted on a side of the slider;

a column-shaped connecting post connecting a front portion of the upper mounting plate and a front portion of the lower mounting plate at a front side of the slider, wherein the upper mounting plate comprises: an upper plate configured to be arranged above an upper blade of the slider and formed with a through-hole penetrating through the upper mounting plate in an upward and downward direction in order to allow a pull tab of the slider to pass through the through-hole; and an upper wall protruding downward from the upper plate, wherein the lower mounting plate comprises: a lower plate configured to be arranged below a lower blade of the slider; and a lower wall configured to surround a front side and right and left sides of an outer periphery of the lower blade and protruding upward from the lower plate, and wherein the lower mounting plate comprises a protrusion protruding toward the slider from an inner peripheral surface of the lower wall and configured to come in close contact with a part of an outer peripheral surface of the lower blade such that a gap is formed between the inner peripheral surface of the slider cover and the outer peripheral surface of the slider when the slider cover is attached to the slider.

9. The slider cover according to claim 8, wherein the upper wall is configured to surround a front side and right and left sides of an outer periphery of the upper blade and to be arranged at a front side and right and left sides of the through-hole.

10. The slider cover according to claim 8, wherein the protrusion comprises a pair of lower protrusions protruding from the inner peripheral surface of the lower wall in a bilaterially symmetrical manner.

11. The slider cover according to claim 10, wherein the upper mounting plate comprises a pair of upper protrusions protruding from the inner peripheral surface of the upper wall in a bilaterally symmetrical manner.

12. The slider cover according to claim 11, wherein the upper wall comprises an upper front wall arranged at the front side of the through-hole, and a pair of upper side walls arranged at the right and left sides of the through-hole, wherein the pair of upper side walls are configured so that a distance therebetween in a right and left direction is gradually narrowed rearward, and wherein the pair of upper protrusions protrude from the inner peripheral surface of the pair of upper side walls in the bilaterally symmetrical manner.

13. A slider set comprising the slider cover according to claim 8, and the slider mounted with the slider cover, wherein the slider comprises: the upper blade; the lower blade opposing the upper blade in the upward and downward direction; a guide post connecting a front portion of the upper blade and a front portion of the lower blade; a pull tab attachment portion protruding upward from the upper blade; and a pull tab attached to the pull tab attachment portion, wherein the slider cover is configured so that the upper wall is formed into a shape following the upper blade with a gap interposed therebetween and the lower wall is formed into a shape following the lower blade with a gap interposed therebetween, and wherein the protrusion is in close contact with the at least corresponding the lower blade.

14. A slider set comprising the slider cover according to claim 12, and the slider mounted with the slider cover, wherein the slider comprises: the upper blade, the lower blade opposing the upper blade in the upward and downward direction, a guide post connecting a front portion of the upper blade and a front portion of the lower blade; a pull tab attachment portion protruding upward from the upper blade; and a pull tab attached to the pull tab attachment portion, wherein the upper blade has an upper narrowed portion configured so that a width thereof in the right and left direction is gradually narrowed rearward, wherein the slider cover is configured so that the upper wall is formed into a shape following the upper blade with a gap interposed therebetween and the lower wall is formed into a shape following the lower blade with a gap interposed therebetween, wherein the pair of upper protrusions are in close contact with right and left surfaces of the upper narrowed portion, and wherein the pair of lower protrusions are in close contact with the lower blade.

* * * * *